US009170075B2

(12) United States Patent
Kangas

(10) Patent No.: US 9,170,075 B2
(45) Date of Patent: Oct. 27, 2015

(54) HANDHELD LASER SMALL ARM

(76) Inventor: Miikka M. Kangas, Camarillo, CA (US)

( * ) Notice: Subject to any disclaimer, the term of this patent is extended or adjusted under 35 U.S.C. 154(b) by 161 days.

(21) Appl. No.: 13/444,689

(22) Filed: Apr. 11, 2012

(65) Prior Publication Data

US 2012/0300803 A1 Nov. 29, 2012

Related U.S. Application Data

(60) Provisional application No. 61/489,012, filed on May 23, 2011.

(51) Int. Cl.
*H01S 5/024* (2006.01)
*F41H 13/00* (2006.01)

(52) U.S. Cl.
CPC ..... *F41H 13/005* (2013.01); *F41H 13/0087* (2013.01)

(58) Field of Classification Search
CPC ..... H01S 5/024
USPC ..... 250/492.1
See application file for complete search history.

(56) References Cited

U.S. PATENT DOCUMENTS 3,766,492 A * 10/1973 Rosati ..... H01S 3/092 372/38.06
3,898,747 A * 8/1975 Marshall ..... F41A 33/02 42/106
4,099,142 A 7/1978 Hershkowitz et al.
4,487,583 A * 12/1984 Brucker ..... F41G 3/2655 434/22
4,979,180 A 12/1990 Muncheryan
5,072,342 A * 12/1991 Minovitch ..... 362/111
5,121,400 A * 6/1992 Verdiell et al. ..... 372/32
5,914,542 A * 6/1999 Weimer ..... H02J 7/345 307/125
5,924,234 A 7/1999 Bindon et al.
6,007,218 A 12/1999 German et al.
6,118,250 A * 9/2000 Hutchison et al. ..... 320/110
6,130,902 A * 10/2000 Shimoji ..... 372/34

(Continued)

FOREIGN PATENT DOCUMENTS

EP 1 450 499 A2 8/2004
WO WO 97/08489 3/1997

(Continued)

OTHER PUBLICATIONS

International Search Report and Written Opinion for corresponding international patent application No. PCT/US2012/033137; mailed Jan. 18, 2013, 7pp.

(Continued)

*Primary Examiner* — Phillip A Johnston
(74) *Attorney, Agent, or Firm* — Christie, Parker & Hale, LLP

(57) ABSTRACT

A hand-held laser weapon including: a laser module for generating a laser light; a telescope module fiber optically coupled to the laser module for focusing the laser light on a target; a burst power module, including a storage capacitor, for storing electrical energy capable of a rapid release in the form of a current; a trickle power module including a battery for providing said electrical energy to the burst power module; a drive circuit for driving the laser module with the stored electrical energy to generate the laser light; a trigger module for providing the stored electrical energy to the drive circuit; and a structure for coupling at least the laser module, the telescope module, the drive circuit and the trigger module together.

16 Claims, 11 Drawing Sheets

(56) References Cited

U.S. PATENT DOCUMENTS

| | | | | |
|---|---|---|---|---|
| 6,142,650 | A * | 11/2000 | Brown et al. | 362/259 |
| 6,774,338 | B2 | 8/2004 | Baker et al. | |
| 6,799,868 | B2 | 10/2004 | Brown et al. | |
| 6,822,994 | B2 | 11/2004 | Kennedy | |
| 6,960,776 | B2 | 11/2005 | Machi | |
| 7,040,780 | B2 | 5/2006 | Diehl | |
| 7,220,957 | B2 * | 5/2007 | Choi | F41H 13/0087 219/121.63 |
| 7,359,114 | B2 | 4/2008 | Sauter et al. | |
| 7,483,454 | B2 | 1/2009 | Hauck et al. | |
| 7,490,538 | B2 | 2/2009 | Lowell et al. | |
| 7,497,586 | B2 | 3/2009 | Eisenberg et al. | |
| 7,730,819 | B2 | 6/2010 | Lowell et al. | |
| 7,784,390 | B1 | 8/2010 | Lowell et al. | |
| 7,796,251 | B2 | 9/2010 | Ponsardin et al. | |
| 7,866,082 | B2 | 1/2011 | Eisenberg et al. | |
| 7,889,499 | B2 | 2/2011 | Lowell et al. | |
| 8,049,173 | B1 | 11/2011 | Brown | |
| 8,114,067 | B1 | 2/2012 | Ketteridge et al. | |
| 2004/0200341 | A1 | 10/2004 | Walters et al. | |
| 2005/0185403 | A1 * | 8/2005 | Diehl | F41H 13/0081 362/259 |
| 2007/0109784 | A1 | 5/2007 | Kosnik et al. | |
| 2007/0279011 | A1 * | 12/2007 | Jones | H02J 7/345 320/167 |
| 2010/0172136 | A1 | 7/2010 | Williamson, III et al. | |
| 2010/0238680 | A1 | 9/2010 | Stuart | |
| 2011/0000123 | A1 | 1/2011 | Taufman et al. | |
| 2011/0024403 | A1 | 2/2011 | Bradley et al. | |
| 2011/0024405 | A1 | 2/2011 | Bradley et al. | |
| 2011/0216792 | A1 | 9/2011 | Chann et al. | |
| 2011/0305250 | A1 | 12/2011 | Chann et al. | |
| 2011/0305256 | A1 | 12/2011 | Chann et al. | |
| 2012/0017845 | A1 | 1/2012 | Scott | |
| 2012/0075843 | A1 | 3/2012 | Battis | |

FOREIGN PATENT DOCUMENTS

| | | | |
|---|---|---|---|
| WO | WO 2004/075718 | A2 | 9/2004 |
| WO | WO 2011/116067 | A2 | 9/2011 |
| WO | WO 2011/116067 | A3 | 9/2011 |

OTHER PUBLICATIONS

Extended European Search Report from corresponding European Patent Application No. 12805300.6, mailed Feb. 11, 2015, 8pp.

* cited by examiner

HANDHELD LASER SMALL ARM

CROSS-REFERENCE TO RELATED APPLICATIONS

This patent application claims the benefits of U.S. Provisional Patent Application Ser. No. 61/489,012, filed on May 23, 2011 and entitled "Handheld Laser Small Arm," the entire content of which is hereby expressly incorporated by reference.

FIELD OF THE INVENTION

The present invention relates generally to lasers; and more particularly to a handheld laser small arm.

BACKGROUND

Conventional firearms, such as gunpowder and ballistic projectile based rifles are typically loud, generate a visible flash, show up in Forward looking infrared (FLIR) imagery as hot sources after usage, generate a recoil kickback, have bullet drop trajectories that are impacted by wind and gravity over long distances, consume ammunition that must be carried and cannot be replenished in the field from renewable sources, and may send bullets that travel past the intended target and strike unintended targets out of sight of the user. It is difficult to use these devices without drawing attention, even with flash and noise suppressors, and dangerous to use in an urban setting without possible unintended targets being injured or killed by stray fire. Also, mounting such a device on a small robot or miniature unmanned flying machine can unbalance them if they are used, or disturb the pointing of a lightweight pan-tilt platform.

SUMMARY

The present invention is a handheld laser weapon. It has advantages over conventional ammunition based weaponry as it does not have lethal impact outside its desired focal set point, reducing collateral or unintended damage, and it has operational security features such as reduced audibility, visibility, lack of recoil, true line of sight aiming, and rechargability from energy resources rather than relying on material ammunition supplies.

In some embodiments, the present invention is a hand-held laser weapon including: a laser module for generating a laser light; a telescope module fiber optically coupled to the laser module for focusing the laser light on a target; a burst power module, including a storage capacitor, for storing electrical energy capable of a rapid release in the form of a current; a trickle power module including a battery for providing said electrical energy to the burst power module; a drive circuit for driving the laser module with the stored electrical energy to generate the laser light; a trigger module for providing the stored electrical energy to the drive circuit; and a structure for coupling at least the laser module, the telescope module, the drive circuit and the trigger module together.

In some embodiments, the laser weapon further includes one or more of: a cooling element coupled to the structure for dissipating heat from the structure; a Yttrium Aluminum Garnet (YAG) crystal for converting the laser light into a coherent directional output; a charge indicator for indicating the laser weapon is ready to fire, after charge is built up on the storage capacitor, a ready detect circuit for outputting a signal, when the voltage across the capacitor exceeds a predetermined value; and one or more temperature sensors for outputting one or more signals, when temperature of any component of the laser weapon exceeds a predetermined value.

DETAILED DESCRIPTION

In some embodiments, the present invention is a handheld laser weapon that makes no noise, generates no visible firing signature, generates no kickback, has controllable range based on focus so that unintended targets are not shot. The laser weapon may further have pure line of sight aiming within the effective focus range of the weapon without hindrance from wind or gravity, and can be reloaded from energy resources, rather than physical ammunition.

The laser weapon of the present invention can have a significant niche role in military, home defense, or law enforcement operations. Moreover, conventional ballistic weapons such as handguns and rifles could penetrate pressure bulkheads or drywall in residential buildings, while a laser weapon of the present invention can be defocused and harmless beyond the intended target range.

Figure 1:
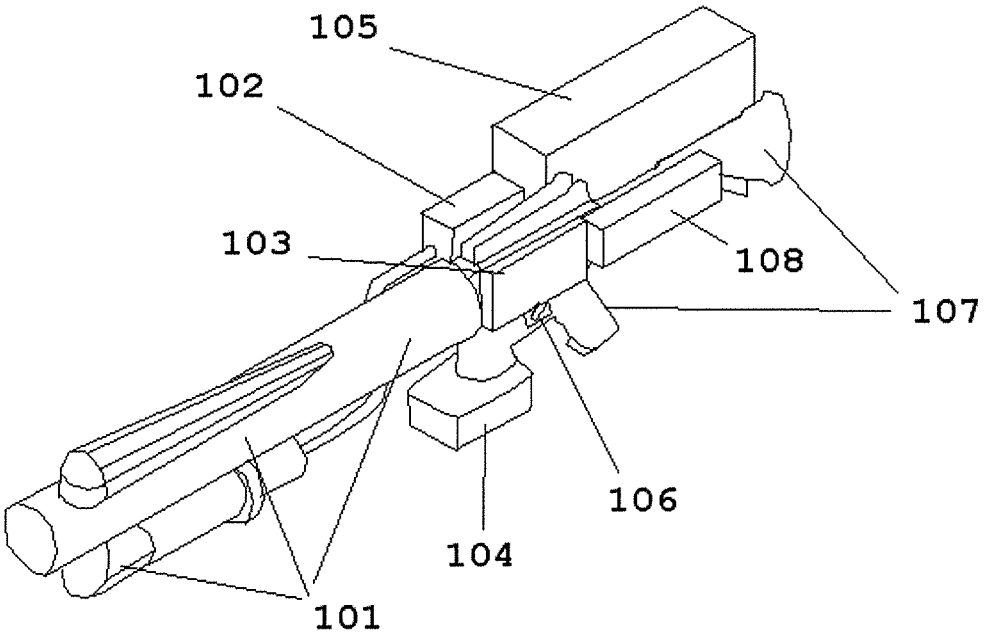
FIG. 1 is a perspective view of a laser weapon, according to some embodiments of the present invention.

FIG. 1 shows an exemplary laser weapon, according to some embodiments of the present invention. As shown, the laser weapon includes several components/modules which when combined form the weapon. A telescope (optics module) 101 is optically coupled to a laser module 102, which receives electrical power from a drive circuit 103, whenever a trigger 106 is activated. The laser module 102 is fiber optically coupled (not shown) to the telescope 101. The laser drive circuit 103 causes the laser module 102 to create laser light which is beamed out of the telescope 101 and focused on a target to generate the weapon effect. A trickle power module 104 charges a burst power module 105 until sufficient charge is built up for the weapon to fire. A structure (frame/base) 107 allows a user to handle and manipulate the weapon. An optional cooling module 108 dissipates the heat from the structure 107 to the surrounding air when high rates of operation are desired. Otherwise, the structure 107 serves to sink waste heat from components and is cooled by convection to the surrounding air.

The various modules of the exemplary laser weapon can be attached to each other, or be separated by electrical or optical tethers, such as power lines or fiber optic lines, or have portions located at different physical locations, such as worn in a backpack or a belt, without altering the basic invention.

Figure 2:
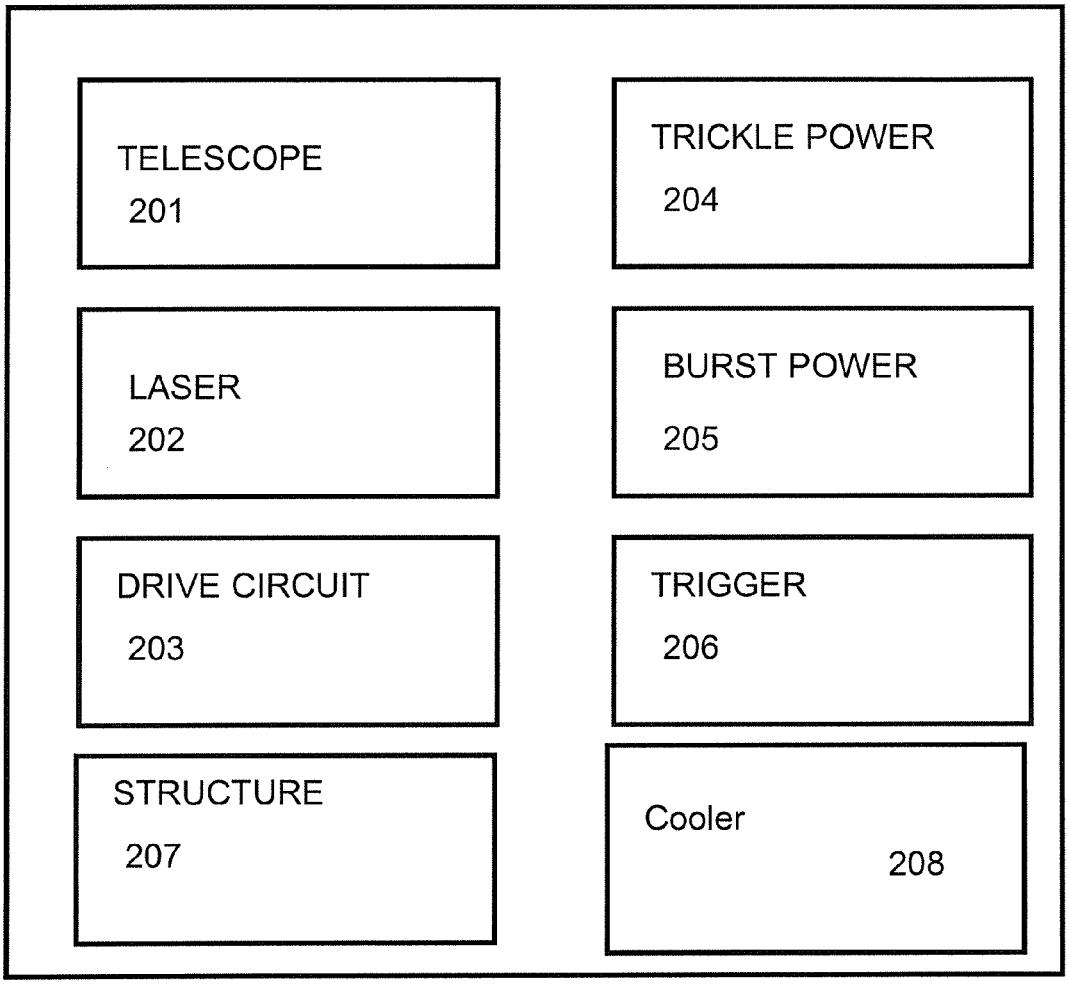
FIG. 2 is an exemplary block diagram of a laser weapon, according to some embodiments of the present invention.

FIG. 2 is an exemplary block diagram of a laser weapon 200, according to some embodiments of the present invention. As shown, a telescope (optic) module 201 is connected to a laser module 202. A driving circuit 203 drives the laser 202 with sufficient current to create a high CW laser beam. A burst power module 205, which stores up energy in for example, a charged capacitor of at least several farads of capacity, is capable of a rapid release of energy in the form of a high electrical current. A trickle power (energy storage and slow release) module 204 charges up the burst power (energy storage and rapid release) module 205, before it is released by the trigger module 206 to fire the weapon by energizing the drive circuit 203. A structure (frame) 207 may hold the parts together and allow the user to manipulate and aim the weapon. This structure may also be used as a heat sink for the modules, and may contain a cooling element 208 such as, a thermoelectric (TE) cooler with a convective heat sink to the surrounding air provide additional heat removal if high rates of operation are desired and supported by the components in the modules.

Figure 3:
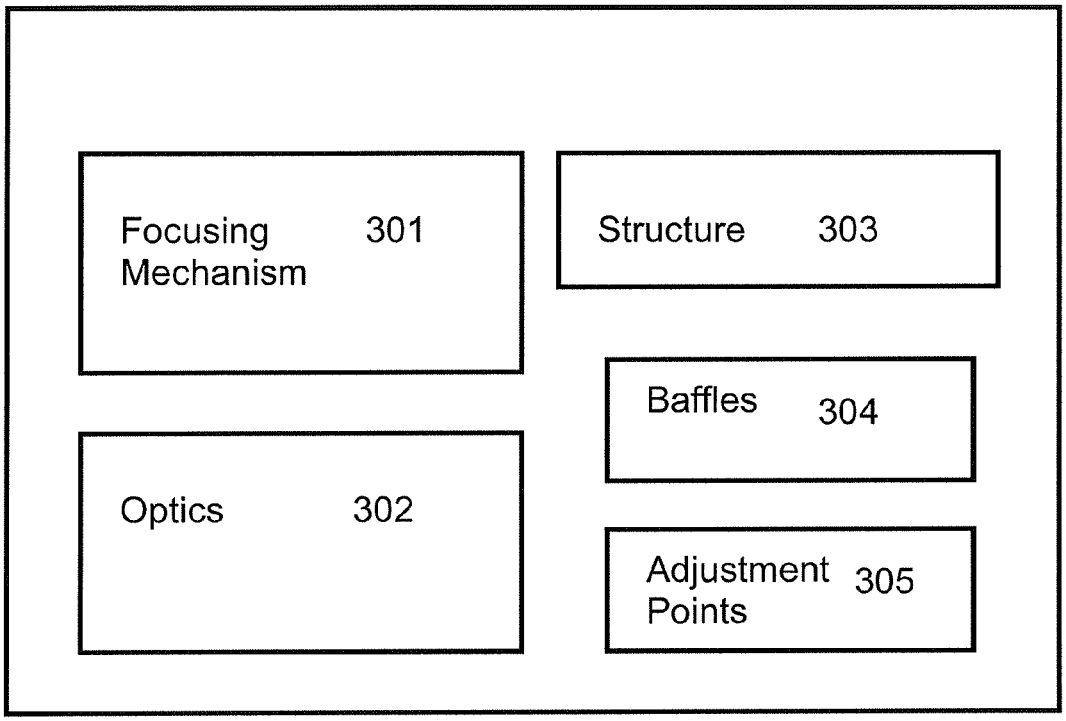
FIG. 3 is an exemplary block diagram of a telescope module, according to some embodiments of the present invention.

FIG. 3 shows a telescope module 300, according to some embodiments of the present invention. The telescope module 300 takes the laser light from a laser module and focuses it at a distance to maximize the flux at the target. In some embodiments, the telescope optic 302 is designed to take the beam from the laser and focus it on a target at a desired range. The telescope module contains optics 302, and a structure that holds the optics in place 303. Additionally, a focusing mechanism 301 made of movable or adjustable lenses or mirrors allows for adjustment of the range where the beam waist is minimized and therefore the maximum optical power density is achieved. A telescope structure (frame) 303, such as an optical bench or frame, holds optical elements in place. Optionally, optical baffles 304 may be present to reduce stray light, and adjustment points 305 that allow redirection of optical elements by a mechanism such as turning screws or knobs to allow tuning of the optics. A possible focusing mechanism 301 can be a dovetail slider with a fiber optic fed glass divergent lens.

Figure 9:
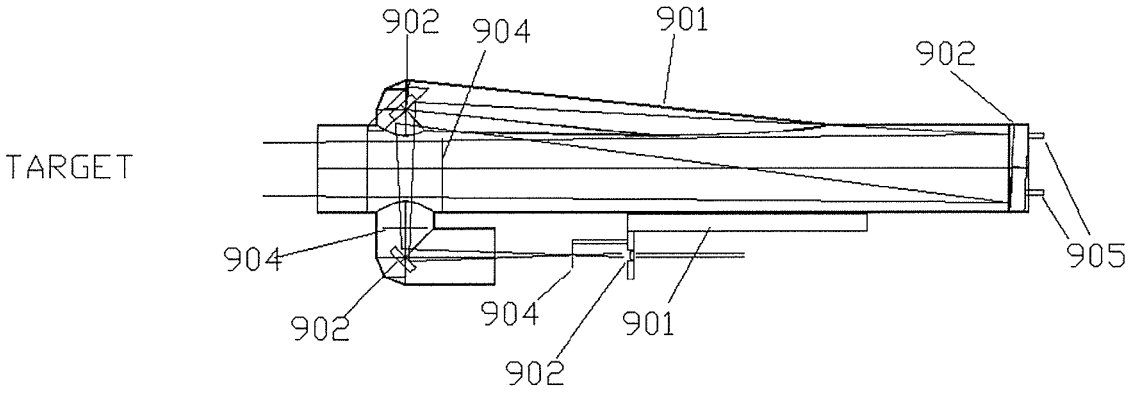
FIG. 9 is a side cutaway view of a telescope, according to some embodiments of the present invention.

In some embodiments, the telescope module comprises of an off-axis parabolic or spherical protected gold first surface mirror. Because this is not a imaging telescope, light rays that are off-axis from the main boresight are not critical to the function, so the design is considerably simpler than a typical telescope used for imaging purposes and spherical mirrors can be utilized as well as parabolic mirrors. Simple lenses and mirrors can be used for the telescope module, although a more sophisticated design can also be utilized. FIG. 9 shows a side cutaway illustration of an embodiment of the telescope fold mirrors and primary mirror and is discussed in detail below.

When a fiber coupled output diode laser is used as the laser module, the telescope module 300 maximizes the flux density of the light at the target, such as by making an image of the output fiber end at the target. For adjustment of the mirrors or optical elements 302, a variable focal length lens which may be AR coated to maximize power from the laser is used to maximize flux density at the target. This optics 302 can be a combination of reflective or refractive elements, or it can be purely reflective or purely refractive. In some embodiments, the telescope module includes a fiber optic output coupler to a collimating lens, which then feeds a telescopic mirror assembly that in effect focuses the fiber output onto the target. For very short ranges, there may be no need for telescope optics at all and a typical 1 milliradian divergence from the laser module can be directed forward without a need for a focusing mechanism. In this short range case, the telescope module may effectively be an optional component.

Figure 4:
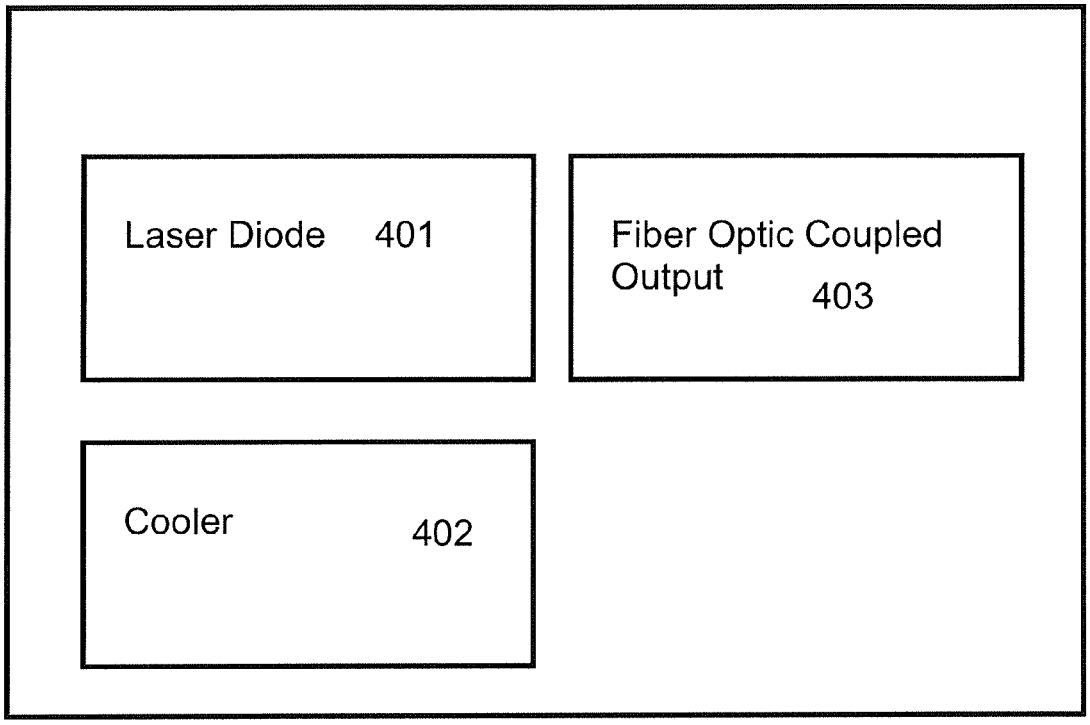
FIG. 4 is an exemplary block diagram of a laser module, according to some embodiments of the present invention

FIG. 4 shows an exemplary laser module, according to some embodiments of the present invention. The laser module 400 generates laser light to be shot out of the telescope module. In some embodiments, laser module contains a 808 nanometer output solid state diode laser in the 50 to 100 watt continuous waveform (CW) range, with a fiber coupled output 403 such as a 800 micron diameter glass fiber. This laser can be used as-is, or it can be used to pump a crystal, for example a Yttrium Aluminum Garnet (YAG) crystal. A YAG crystal absorbs 808 nm infrared light and converts it into 1.06 micron infrared laser light, with a coherent directional output. However, YAG lasers are not necessary for this invention and other types of lasers may be used as the laser module. Greater power can be achieved without pumping a YAG crystal, so to optimize CW power a raw laser diode output can be used.

The laser module can be a fiber coupled coherent diode laser array combined together to form a single high CW output on a glass fiber. For low duty cycle and for short bursts such as a quarter second every few minutes, no cooling may be necessary other than heat sinking to the weapon structures such as, the telescope frame 303 and the structure (frame) 207, and resulting convection with surrounding air. Optionally, a thermoelectric (TE) cooler or other cooling method can be used. A possible fiber optically coupled diode laser is a 808 nm 50 watt diode laser block with a typical 1 milliradian beam divergence from a 800 micron diameter fiber. This uses about 1 amp per watt above a pre-lasing current that is on the order of 10 amps. The 60 amps at 2.2 volts that is typically needed to drive such a typical diode laser is achieved by the drive circuit 203 such as typically a bucking power supply 501 converts the high variable voltage from a capacitor 701 driving a constant current biasing circuit 503 using the charge built up on the burst power module 205 which typically could be a 30 farad audio system super capacitor.

Figure 5:
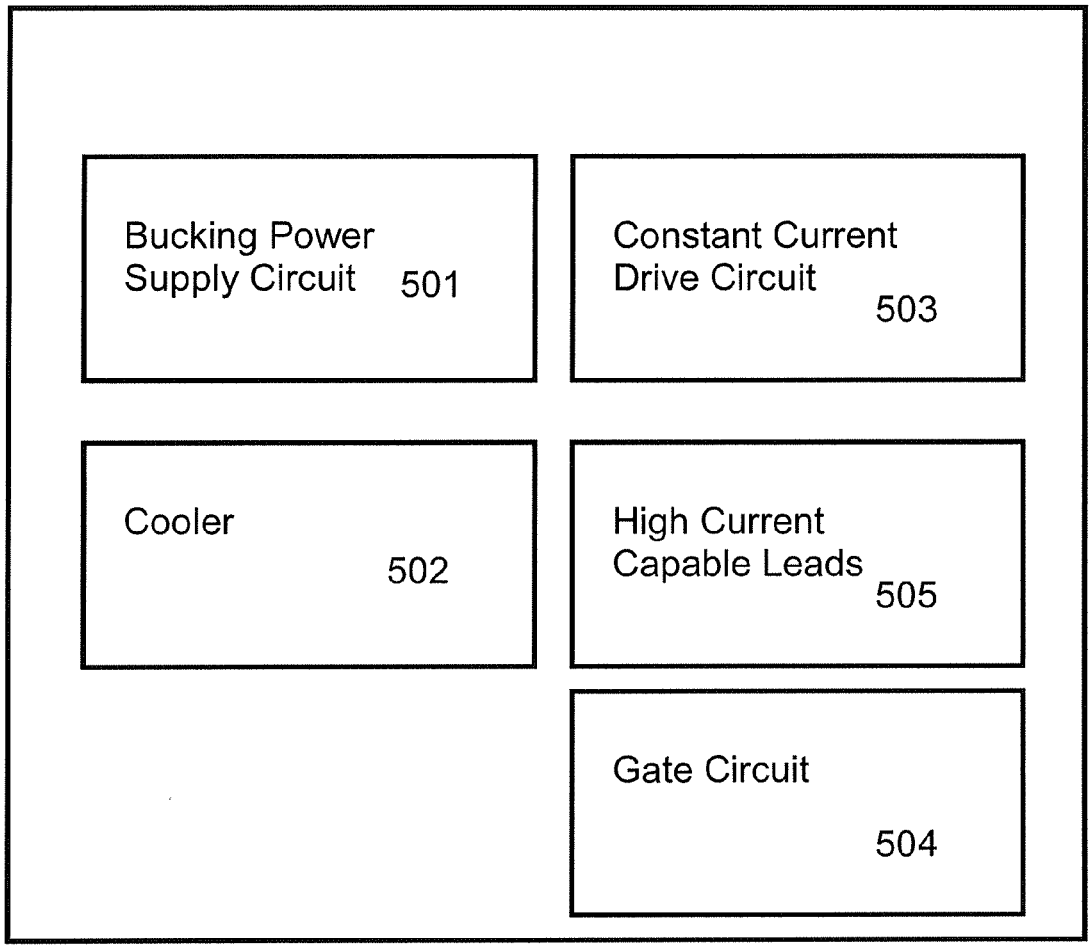
FIG. 5 is an exemplary block diagram of a drive circuit module, according to some embodiments of the present invention

FIG. 5 shows an exemplary laser drive circuit 500, according to some embodiments of the present invention. The laser drive circuit 500 converts a potentially significantly variable input voltage from a burst power module into a stable current to drive the laser module, when the trigger 106 is activated. In some embodiments, the laser drive circuit 203 comprises of a bucking power supply 501 to convert a rapidly dropping voltage off the burst capacitor 701 into a stable voltage with a moderately high current capability of many tens to hundreds of amps. A constant current drive circuit 503 takes a stable voltage with a moderately high current capability and converts it into a lower voltage but a stabilized constant higher current.

Optionally, a voltage regulator circuit can be used instead of the bucking power supply and constant current bias circuit. Diode lasers typically require a stable constant current biasing to operate but can be voltage driven as well with increased risk of damage to the laser in use. In some embodiments, high current capable leads are used for both input from the capacitor and the output to the laser module. Optionally, a gate input circuit 504 may activate or enable the firing of the weapon. For a diode laser, the constant current drive circuit 503 may be a constant current diode bias circuit designed to produce sufficient current to drive the laser diode for the duration of the laser shot. This can be a 100 amp capable drive circuit such as a FM-100 fast diode modulator. Typically this generates a constant current of 50 to 100 amps at 2.2-2.4 volts depending on the set-point of the circuit for a typical 808 nm 50-100 watt diode laser block. For a short duration burst of a quarter to half second, and for a low duty cycle, no additional cooling may be required. Optionally, cooling can be achieved by heat sinking to the structure of the laser weapon, augmented by a cooler 502 such as TE coolers if desired.

Figure 6:
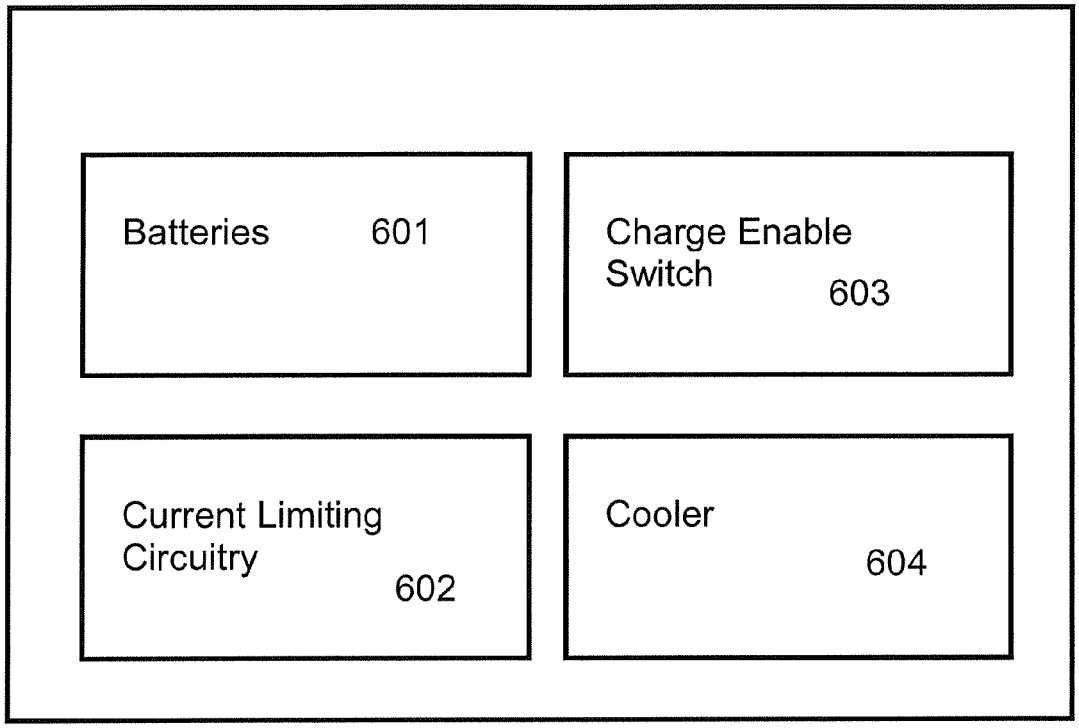
FIG. 6 is an exemplary block diagram of a trickle power module, according to some embodiments of the present invention

FIG. 6 shows an exemplary trickle power unit 600, according to some embodiments of the present invention. The trickle energy module 600 is to charge the burst power module, which is used for high peak power to drive the laser weapon. Since present day common technologies such as commercial off-the-shelf batteries that store large amounts of energy are limited in their peak power output by their internal resistance, the maximum power output from these storage methods is often limited.

Figure 7:
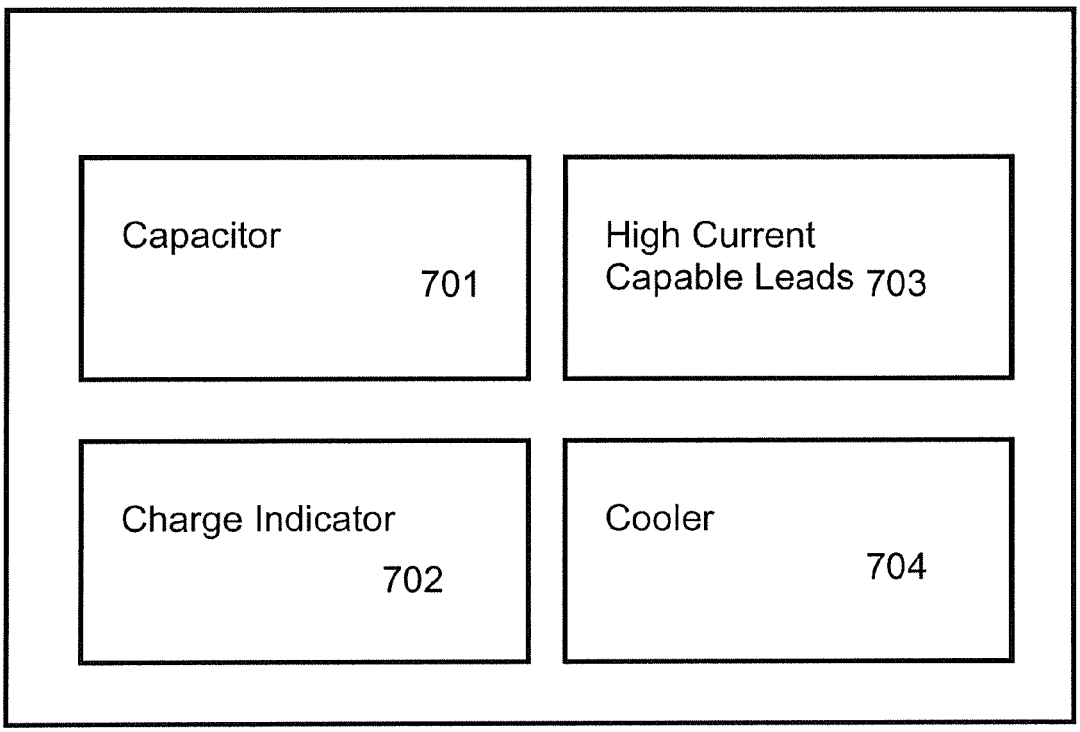
FIG. 7 is an exemplary block diagram of a burst power module, according to some embodiments of the present invention

As shown, the trickle energy module 600 includes batteries 601, an optional charge enable switch 603, an optional current limiting circuit 602, such as a low ohm value power resistor, to prevent battery damage by short circuit charging of a burst power capacitor (shown in FIG. 7). The battery 601 can be an off the shelf battery such as a typical cordless drill battery, or any array of voltaic cells that typically make up a battery. If the rate of fire is high based on the capabilities of the other components, an optional cooler 604, such as a TE cooler, can be added to the trickle energy module to cool the battery and improve its performance.

The optional charge enable switch 603 disconnects the trickle power source from the burst energy storage to prevent energy drain while idle. Enabling the charge enable switch charges the burst energy storage, which releases power through the laser drive circuit 203 when the trigger is activated.

In some embodiments, the trickle energy module is a battery or array of batteries that allows for charging of the capacitor. The trickle energy module may also be combined with the capacitor in some embodiments. For example, if batteries are attached to a capacitor as an assembly then, this assembly may be removable as an energy clip or magazine, rather than having just the batteries removable as an energy clip or magazine. The energy stored in a trickle power module (such as a battery) is sufficient to charge up the burst power module (a large capacitor) several times before being depleted.

FIG. 7 shows the burst power/energy module 700, according to some embodiments of the present invention. The burst energy module 700 builds up charge while electrically coupled to a power supply (trickle power module) and allows rapid high power energy release into a drive circuit when a trigger is activated. Since the maximum power produced from short circuiting a typical battery is limited by its internal resistance, it is difficult to generate a high power burst from any battery, even if the battery has sufficient energy stored in it to create laser weapon shots. To eliminate this limitation, a large capacitor such as a super capacitor similar to those recently developed for the automotive industry, such as a Power Acoustik™ PCX-30F car audio system 30 Farad capacitor, is used to build up charge from a battery. The internal structure of the super capacitor may be made of layers of conductive material separated by an insulator. The terminals of the super capacitor and its internal resistance are such that several kilowatts or even greater power can be generated from short circuiting the terminals of the super capacitor, which depletes the charge on the super capacitor to be recharged over time from the battery.

In some embodiments, a super capacitor or array of smaller capacitors are capable of storing the energy roughly equal to or greater than that of a small caliber bullet. The capacitor includes high current capable leads 703 for discharging into the drive circuit upon activation of the trigger. These high current capable leads 703 may also be used to build up charge from the trickle power, such as when charge enable 603 is on. Other capacitors and voltage ranges can be used, as long as the energy stored is sufficient to create the intended weapon effect on the target. For example, the capacitor may be an a off-the-shelf 20-40 Farad super-capacitor, which can charge from a battery. An optional charge indicator 702 may indicate the weapon is ready to fire, after charge is built up on the capacitor 701, or may enable the drive circuit to fire in an automatic weapon fashion by enabling a gate circuit 504. An optional cooler 704 may be used to cool lead wires or capacitors if a high rate of fire is desired and allowed by the other weapon components.

In some embodiments, the burst power system is capable of multi-kilowatt output, and is not limited to diode lasers in the many tens to hundreds of watts of power. Any laser can also be driven by this burst power module including lasers generating many kilowatts of peak power for short amounts of time or CO2 laser tubes with appropriate drive circuitry. It can also drive other weapons or high peak power electronic devices such as other handheld energy weapons, construction industry nail guns, electric shock devices, spot welders, portable surgical devices, or other high peak power devices.

Figure 8:
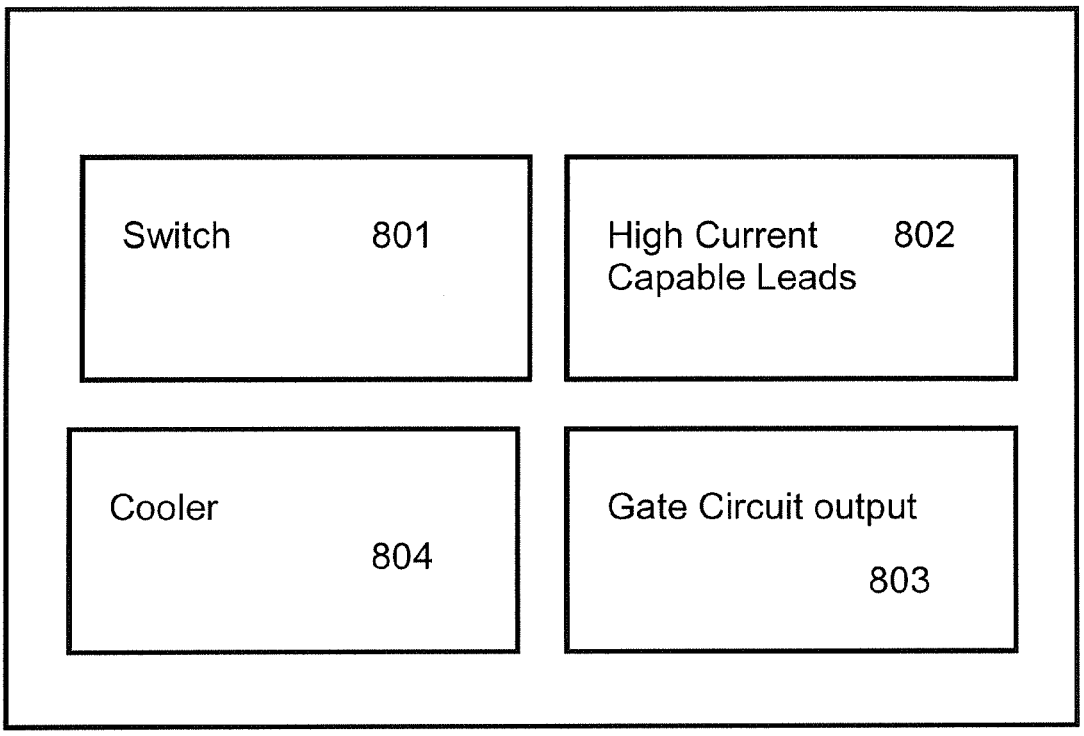
FIG. 8 is an exemplary block diagram of a trigger module, according to some embodiments of the present invention

FIG. 8 shows an exemplary trigger module 800, according to some embodiments of the present invention. The trigger module 800 allows the charge stored in the burst module to energize the drive circuit allowing a high current to pass from the burst power module to the laser drive circuit input. The trigger module includes a switch and is capable of energizing the drive circuit either by allowing high current to pass through it for a low duty cycle operation, or it may activate a gate circuit on the drive module that allows the laser drive circuit to activate the laser.

The switch may be a robust switch such as a cordless drill switch capable of intermittent bursts of high currents such as several tens of amps or more at the voltage levels of the capacitor charge at a low duty cycle so that heat from resistive losses can dissipate between shots and not cause melting or overheating of the switch. It can alternatively be a low power control switch that enables a control input into the laser drive circuit, if the laser drive circuit has separate control inputs and power inputs.

As shown in FIG. 8, the trigger module includes a switch 801 which may be any suitable switch such as a household cordless drill trigger switch. The switch has wiring 802 that is capable of low duty cycle high current bursts. This can be household computer power supply wiring, which although typically rated for much lower currents and wattages, and is capable of handling many tens of amperes of current at typical DC voltages for brief times that are long enough to fire the weapon without melting the wire or its insulation. An optional cooler 804, such as a typical TE cooler, can be available to cool the wiring and switch if higher rates of fire are desired and the rest of the weapon components allow it.

An optional mode of operation is a gate circuit output 803. A gate circuit, such as a low voltage digital TTL output signal from a trigger button or a switch that drives transistors or relays within the drive circuit, causes the trigger to generate a low power signal voltage to the drive circuit. In some embodiments, this can be implemented as a pull-up circuit with a resistor pulling the circuit voltage to a logic high volts such as 5 volts, and a short to ground when the trigger is pulled to generate the ground voltage. This variant eliminates the need for high power passing directly through the switch. With this mode of operation, the burst power module may not be connected to the trigger module, but instead, be connected directly to the drive circuit's high current capable leads. The trigger gate circuit output 803 then activates the gate circuit in the drive module, which accepts voltage low as the true logic value an voltage high as the false logic value. When optional gate circuit output 803 is used, the high current capable leads 802 may not be required.

In some embodiments, the trigger module activates the laser drive circuit by either enabling the drive circuit by low power signaling such as a transistor-transistor logic (TTL) voltage level low current switch or by allowing a large amount of current to flow and directly connecting the burst power module to the drive circuit such as a cordless drill switch. A possible trigger switch may be a cordless drill switch, which can take very high currents such as 50-60 amps for a 50 watt diode laser intermittently at a low duty cycle such as for a one half second duration every few minutes.

FIG. 9 shows a cutaway view of a possible telescope module 900, according to some embodiments of the present invention. In some embodiments, a 3" diameter protected gold spherical primary mirror with a focal length of 750 mm, is used with two first surface protected gold flat mirrors for fold mirrors. The focus is adjusted by changing the distance between the fold mirrors and a divergent lens from the laser source.

The focusing module 901 moves back and forth to change the relative location of optics components 902 from each other, producing a variable target range for minimized beam diameter. The telescope structure (base) 903 holds the optics together and in alignment with each other. The structure can also serve as a heat sink for other modules in the weapon. Optional baffles 904 help control stray light such as apertures for spatial filtering or general straylight control. A possible baffle design places a spatial filter at the focus of a convex mirror that diverges the laser beam from the fiber output and baffles after the fold mirrors and after the primary mirror. Adjustment points 905allow adjustment of optical elements to boresight the weapon A possible adjustment point design is a pair of 80 thread-per-inch ball screws pressing against the primary mirror which is spring loaded to press against the ball screws and pivot around a fixed ball bearing point. This can also be mounted on fold mirrors or other components.

Figure 10:
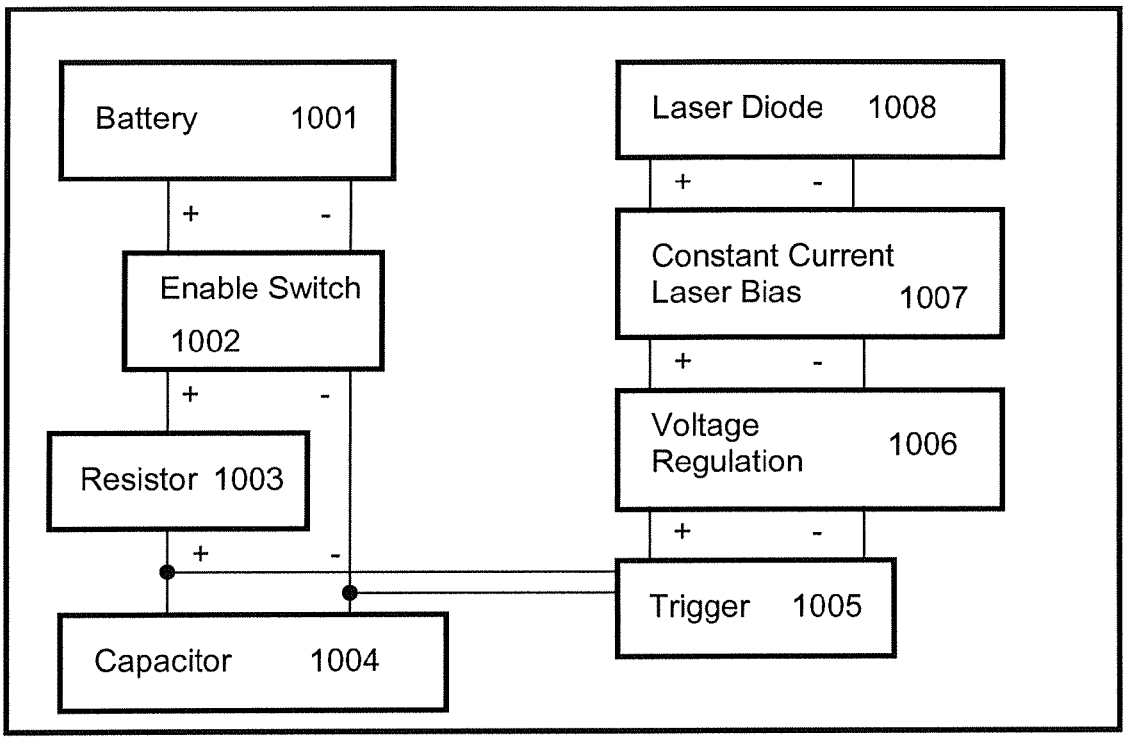
FIG. 10 is a simplified exemplary electrical block diagram, according to some embodiments of the present invention.

FIG. 10 is a simplified exemplary electrical block diagram, according to some embodiments of the present invention. As shown, a battery 1001 is coupled to an enable switch 1002, which is current limited by an optional resistor 1003 to trickle charge a capacitor 1004. The capacitor 1004 is coupled to a trigger switch capable of high momentary currents, such as a cordless drill switch 1005. When trigger 1005 is activated, electrical current flows to the voltage regulator circuit, which may be a bucking power circuit. The voltage regulator circuit acts to stabilize the voltage from the capacitor 1004. This stable voltage then feeds a constant current bias circuit 1007, which generates a roughly 2 to 3 volt signal at roughly 50-60 amps to drive a 50 watt laser diode 1008.

Figure 11:
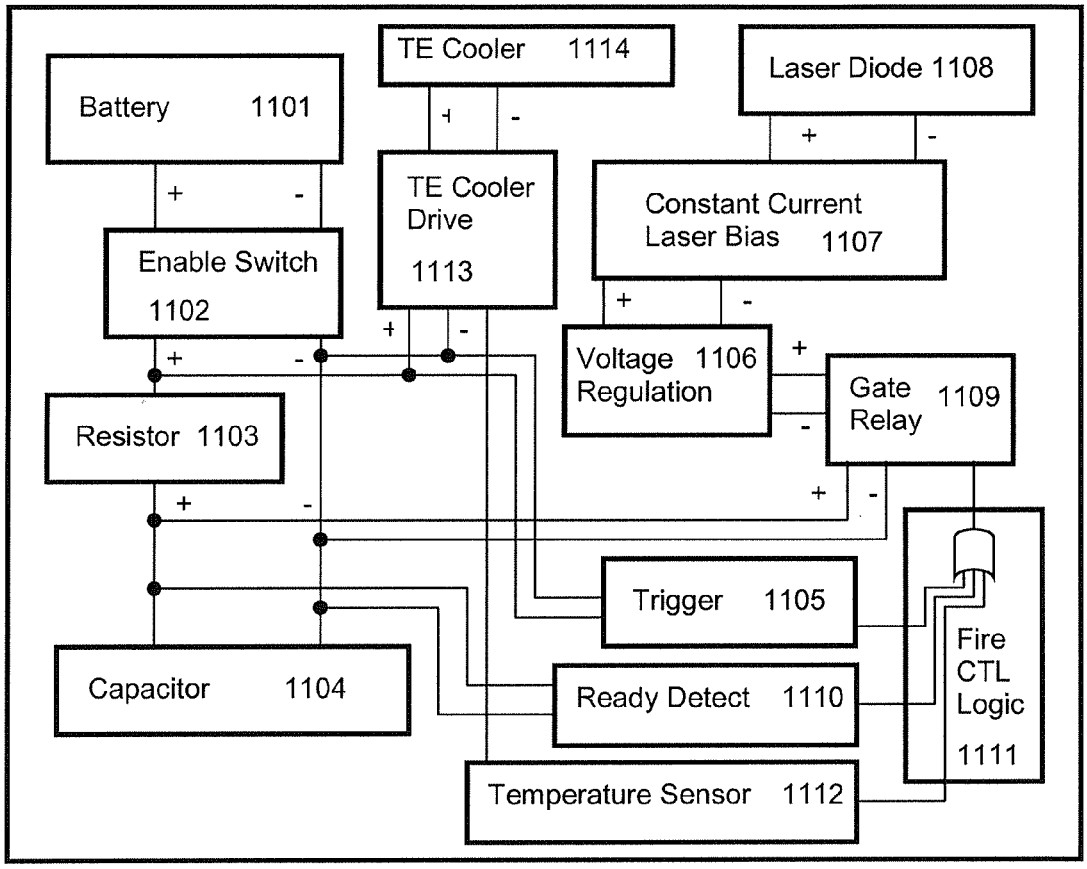
FIG. 11 is an exemplary electrical block diagram, according to some embodiments of the present invention.

FIG. 11 is a variant exemplary electrical block diagram, according to some embodiments of the present invention. These embodiments depict an automatic version of the laser weapon, which allows for multiple shots from a single extended trigger pull. As shown, a battery 1101 is coupled to a enable switch 1102, which is current limited by an optional resistor 1103 to trickle charge a capacitor 1104. A ready detect circuit 1110, which may be embedded in another circuit or be stand alone, outputs a logical true value when the voltage across the capacitor exceeds a set value, such as 18 volts. If the voltage drops because of, for example a trigger activation leading to a laser shot which discharges the capacitor during the shot, then the voltage needs to drop below a reset threshold to turn the logic true value off. The reset threshold is typically lower than the ready voltage.

Temperature of components is monitored by Temperature Sensor 1112, which can be made from a typical temperature sensor like a 2n2222 diode biased by a 500 micro amp constant current and can have a voltage comparator that outputs a logical true if the temperature is low such as a small number of degrees above room temperature. A Thermoelectric (TE) Cooler drive circuit 1113 may be connected to the battery 1101 through an optional enable switch 1102 to operate TE Coolers 1114 such as Marlow brand single stage or multiple stage coolers to cool sensitive items such as the diode laser 1108. To save power, this cooler may be activated only when temperature is higher than safe laser diode 1108 temperature which is typically close to room temperature as measured by the temperature sensor 1112.

Temperature sensor 1112 may output a logical true if the temperature of components is low enough that overheating of components in the laser is not occurring. If the temperature goes too high, then the temperature will have to drop below a reset threshold before the logical true is re-enabled. Multiple temperature sensor and TE coolers can be utilized to monitor or cool separate components. The number of temperature sensors 1112 does not need to match the number of coolers 1114. When trigger 1105 is activated, it generates a logical true value, such as a low voltage digital signal. Outputs from the trigger 1105 and ready detect 1110 and temperature sensor 1112 circuits are analyzed, such as by a fire control logic circuit (fire CTL logic) 1111, which may be a three input and gate which can be physically part of the gate relay 1109, or be separate or located within the other circuits, which then drives a gate relay circuit 1109. The gate relay 1109 can be made of relays or switches to allow control of a large high current relay by the logic signal from the AND circuit 1111. Gate relay circuit 1109 allows electrical current to flow to the voltage regulation circuit (e.g., a bucking power circuit), which acts to stabilize the voltage from the capacitor 1104. This stable voltage then feeds a laser bias circuit 1107 which generates for example a roughly 2.2 to 2.5 volt signal at roughly 50-60 amps to drive a 50 watt 808 nm laser diode 1108.

The above described electrical circuits may be implemented on the same circuit board or implement two or more separate circuit boards. A continuous extended pull on the trigger 1105 can generate multiple laser shots. Coolers and temperature sensor interlock circuits, such as the fire control logic 1111, can be present with or without an automatic multiple firing from extended trigger pull capability.

In some embodiments, full illumination of the mirror by the expanding laser beam from the divergent lens is not necessary, but if a more sophisticated optical design with multiple moving or adjusting elements is used this can also be utilized. For example, a 4-inch change in length of the position of the divergent lens allows adjustment of the range of focus from the weapon from a distance of 10 meters to 100 meters with a spot size at long range of roughly 1 cm, which is sufficient to create local heating for the weapon effect, though may not necessarily be able to create cutting or burning effects. This flux density is sufficient to allow heating of target tissue by a small number of tens of Celsius from absorption of laser energy during the laser shot time duration. The short duration of a half second or less of the laser pulse causes localized heating without allowing the heat to spread. This rapid heating of tissue causes the weapons effect.

For example, animal tissue is translucent at 808 nm so for the case of 808 nm radiation the beam penetrates partly into tissue without being absorbed by the skin and is effectively absorbed within a cm inward of its point of impact. An alternative use could have a medical function as a subsurface surgical instrument for cancer or other treatment if for example the focus is such that tissue outside the desired point of focus is not harmed. For example, brain matter takes irreversible harm above 106 Fahrenheit, therefore only a nominal rapid heating of brain tissue is required to cause a weapons effect with a properly placed laser shot. At closer range the spot size is proportionately smaller and may create cutting or burning effects as well depending on the nature of the target. Optics can be optimized for short range as well which may simplify or eliminate some parts of the telescope or the entire telescope if the range is very short and raw collimated laser output can be used.

It will be recognized by those skilled in the art that various modifications may be made to the illustrated and other embodiments of the invention described above, without departing from the broad inventive scope thereof. It will be understood therefore that the invention is not limited to the particular embodiments or arrangements disclosed, but is rather intended to cover any changes, adaptations or modifications which are within the scope and spirit of the invention as defined by the appended claims.

What is claimed is:

1. A hand-held laser weapon comprising:

a laser module for generating a laser light in a form of a single laser pulse or a Continuous Wave (CW) laser;

a telescope module fiber optically coupled to the laser module for focusing the laser light on a target;

a burst power module including a super-capacitor larger than 20 Farad for storing electrical energy capable of a rapid release in the form of a current, wherein the rate of release is in excess of one kilowatt;

a removable trickle power module including a battery, a current limiting circuit and a charge enable switch for charging said super-capacitor in the burst power module;

a bucking converter and a current bias circuit for converting a high voltage low current output of the super capacitor to a lower voltage and higher current signal;

a drive circuit for driving the laser module with a single laser pulse or a Continuous Wave (CW) output pulse from the stored electrical energy in the super-capacitor to generate the laser light in the form of the single laser pulse or Continuous Wave (CW) laser, from the lower voltage and higher current signal;

wherein the drive circuit further includes a gate input circuit for activating or enabling firing of the laser weapon;

a trigger module for providing the stored electrical energy to the drive circuit; and a structure for coupling at least the laser module, the telescope module, the drive circuit and the trigger module together.

2. The hand-held laser weapon of claim 1, further comprising a cooling element coupled to the structure for dissipating heat from the structure.

3. The hand-held laser weapon of claim 1, wherein the laser weapon comprises two portions, wherein one portion is physically separated from and electrically coupled to the other portion.

4. The hand-held laser weapon of claim 1, wherein the telescope module comprises of an off-axis parabolic or spherical protected gold first surface mirror, a fiber optic output coupler, one or more baffles, a collimating lens, and a focusing mechanism for focusing the lens.

5. The hand-held laser weapon of claim 1, wherein the laser is a coherent diode laser array.

6. The hand-held laser weapon of claim 1, wherein the laser is a 808 nanometer output solid state diode laser in 50 to 100 watt continuous waveform (CW) range with a 800 micron diameter glass fiber.

7. The hand-held laser weapon of claim 1, further comprising a Yttrium Aluminum Garnet (YAG) crystal for converting the laser light into a coherent directional output.

8. The hand-held laser weapon of claim 1, wherein the laser module includes a cooling element.

9. The hand-held laser weapon of claim 1, further comprising a charge indicator for indicating the laser weapon is ready to fire, after charge is built up on the storage capacitor.

10. The hand-held laser weapon of claim 1, wherein the trickle power module includes a current limiting circuit.

11. The hand-held laser weapon of claim 1, wherein the trickle power module includes a thermoelectric (TE) cooler.

12. The hand-held laser weapon of claim 1, wherein the drive circuit includes a constant current drive circuit to converts the stored electrical energy into a stabilized constant current, and a voltage regulator circuit.

13. The hand-held laser weapon of claim 12, wherein the drive circuit further includes a cooling element.

14. The hand-held laser weapon of claim 1, wherein the trigger module includes a switch having wiring capable of low duty cycle high current bursts.

15. The hand-held laser weapon of claim 1, further comprising a ready detect circuit for outputting a signal, when the voltage across the capacitor exceeds a predetermined value.

16. The hand-held laser weapon of claim 1, further comprising one or more temperature sensors for outputting one or more signals, when temperature of any component of the laser weapon exceeds a predetermined value.

* * * * *